US006367397B1

(12) United States Patent
Musco et al.

(10) Patent No.: US 6,367,397 B1
(45) Date of Patent: Apr. 9, 2002

(54) METHOD FOR STITCHING A WORK PIECE USING A COMPUTER CONTROLLED, VISION-AIDED SEWING MACHINE

(75) Inventors: Richard G. Musco, Lake Worth; Howard L. Shaffer, Hillsboro Beach, both of FL (US)

(73) Assignee: Otabo LLC, Pompano Beach, CA (US)

( * ) Notice: Subject to any disclaimer, the term of this patent is extended or adjusted under 35 U.S.C. 154(b) by 0 days.

(21) Appl. No.: 09/825,668

(22) Filed: Apr. 3, 2001

(51) Int. Cl.[7] ..... D05B 21/00

(52) U.S. Cl. ..... 112/475.05; 112/470.07; 12/142 R

(58) Field of Search ..... 112/475.05, 470.07, 112/475.19, 475.03, 470.01, 470.04, 470.06, 102.5; 700/138, 136, 137; 12/142 R, 142 LC, 146 R, 146 L

(56) References Cited

U.S. PATENT DOCUMENTS

| | | | | |
|---|---|---|---|---|
| 4,072,114 A | * | 2/1978 | Sugiyama et al. | 112/470.07 |
| 4,312,282 A | | 1/1982 | Dorosz et al. | 112/121.12 |
| 4,498,404 A | * | 2/1985 | Sadeh | 112/470.04 |
| 4,639,964 A | | 2/1987 | Binder | 12/142 LC |
| 4,655,149 A | | 4/1987 | Szydlek | 112/121.12 |
| 4,784,071 A | | 11/1988 | Sadeh et al. | 112/121.12 |
| 4,817,222 A | | 4/1989 | Shafir | 12/146 L |
| 4,821,657 A | | 4/1989 | Herdeg et al. | 112/121.12 |
| 4,834,008 A | | 5/1989 | Sadeh et al. | 112/121.12 |
| 4,932,343 A | | 6/1990 | Mardix et al. | 112/121.12 |
| 4,934,292 A | | 6/1990 | Mardix et al. | 112/273 |
| 5,094,538 A | | 3/1992 | Reedman et al. | 356/376 |
| 5,205,232 A | | 4/1993 | Sadeh et al. | 112/262.3 |
| 5,259,329 A | | 11/1993 | Reedman et al. | 112/121.12 |
| 5,323,722 A | | 6/1994 | Goto et al. | 112/121.2 |
| 5,481,467 A | | 1/1996 | Smith et al. | 364/474.28 |
| 5,537,939 A | | 7/1996 | Horton | 112/475.19 |
| 5,537,946 A | | 7/1996 | Sadeh et al. | 112/475.03 |
| 5,777,880 A | | 7/1998 | Bowen et al. | 364/470.14 |
| 6,032,860 A | | 3/2000 | Brian | 235/454 |
| 6,216,619 B1 | * | 4/2001 | Musco et al. | 112/475.05 |

FOREIGN PATENT DOCUMENTS

| | | | |
|---|---|---|---|
| EP | 0 221 163 B1 | 9/1990 | D05C/5/04 |
| WO | WO 86/06423 | 11/1986 | D05C/5/04 |

* cited by examiner

*Primary Examiner*—Peter Nerbun
(74) *Attorney, Agent, or Firm*—Townsend and Townsend and Crew LLP

(57) ABSTRACT

A method for stitching one work piece to another or for stitching a decorative stitch line along a work piece. In one embodiment, the method includes first arranging a stencil over at least a portion of a work piece to be stitched where the stencil is cut from a material having a color selected to contrast with a color of the work piece. Next, a computer-controlled sewing apparatus having a machine-vision capability is used to stitch along a path that corresponds generally to an outer edge of the stencil. If necessary, the computer-controlled sewing apparatus can adjust its stitching path in response to detecting the stencil. Then, after stitching is completed, the stencil is removed from the work piece.

21 Claims, 3 Drawing Sheets

METHOD FOR STITCHING A WORK PIECE USING A COMPUTER CONTROLLED, VISION-AIDED SEWING MACHINE

CROSS REFERENCE TO RELATED APPLICATIONS

This application is related to U.S. application Ser. No. 09/420,083 entitled "A METHOD FOR STITCHING A WORK PIECE USING A COMPUTER CONTROLLED, VISION-AIDED SEWING MACHINE", filed on Oct. 18,1999, U.S. Pat. No. 6,216,619 and listing Richard G. Musco and Howard L. Shaffer as coinventors. The disclosure of 09/420,083 is hereby incorporated herein by reference in its entirety.

BACKGROUND OF THE INVENTION

The present invention relates to a computerized manufacturing process. More specifically, the present invention relates to a computerized method that enables work pieces, e.g., parts of a shoe upper, to be accurately sewn together or to be sewn with decorative stitching lines, in a vision-aided, computer-guided process.

Traditional shoemaking techniques use a last, which is a solid form, over which a shoe will be made. The last looks somewhat like a foot, but without the toes and other such detail. Traditionally, lasts are hand crafted out of wood by a last "model maker" and then duplicated in volume, including grading for different sizes, on a special lathe, set up specifically for cutting lasts. A different size last (actually a pair of lasts, one for each foot) is needed for each size of shoe. Thus, a line of shoes that is available in half sizes 5–12 and widths narrow, medium, wide for each size, would require 45 pairs of lasts.

From each last, a shoemaker derives a set of paper patterns for each style of shoe to be made. One traditional way of deriving the paper patters is to cover the model size of a last (e.g., a size 9, medium last for men) with narrow (e.g., ½" wide) strips of tape. Once the last surface is completely covered with tape, the shoemaker would then sketch the shoe on the taped surface, showing all details of the shoe. The tape can then be peeled from the last surface in two halves by first cutting down the centerline of the last (toe to heel) and then laying it flat on a flat surface. The two halves are "joined" along their centerlines in the forefoot area.

This flattened tape is called a flattening and is a mechanical way of taking the 3-D surface of the last and translating it to a 2-D surface. The lines of the shoe on the 3-D surface are also shown on this flattening. From these lines, the shoemaker is able to layout all the patterns of the pieces to be cut (from leather and other materials) which will later be sewn together to make up the upper of the shoe. Typically the shoemaker cuts the pieces out of a heavy paper, thus making a set of paper patterns.

Paper patterns not only show the outline of the pieces to be cut, but all the details necessary to aid in production. This includes any perforations (eyelet holes, for example) or markers. A marker is a slot cut in a paper pattern to indicate the position of lines for stitching or guidance in placement of one part on top of another. From the finished set of paper patterns (including all sizes), a shoemaker can make the necessary cutting dies (normally made from band steel) and other templates and tools needed for production.

This shoemaking process has been in use pretty much unchanged since the beginning of the last century. Only in the past two decades have there been significant efforts and advances in some of these processes. For one, with the advent of computer driven CAD/CAM systems specific to the footwear industry, much of the pattern work is now done by computer instead of by hand. Paper patterns output from computer CAD/CAM systems can be plotted or cut on computer-guided tables, and these patterns used as guides for making steel cutting dies and the other templates and tools necessary for production.

Another area where progress has been made is through the use of computer-guided sewing machines. For example, computerized stitching or sewing machines can be employed to sew various pieces of a shoe together. Some computerized stitching machines perform sewing operations along a predetermined path using a sewing program stored in a computer-readable medium. A major drawback to most of these machines is that they are blind, i.e., they cannot see the work piece being sewn. Leather and textiles, basic work pieces in the manufacture of shoes, are flexible materials that may change size and position before and during the sewing process. Thus, occasionally the predetermined sewing path does not match the actual path being sewn resulting in pieces that are subsequently rejected during quality control inspections.

In order to overcome these deficiencies, companies have developed computerized sewing machines with "machine vision" that detects the edges of the work piece being sewn. Machine vision includes the use of cameras and illuminating lights to detect and enhance the detection respectively of the edge of a work piece. With the edge of the work piece identified, the computer controller within the sewing machine can adjust the sewing path as necessary to compensate for misplacement or movement of the work piece or other variations that may otherwise lead to an erroneous sewing path. Edge detection is a complicated process, however, and slight variations in the lighting conditions, work piece characteristics (e.g., color of the leather) or other factors may cause the edge detection software to not function properly. Thus, set up time for an edge detecting machine vision sewing system is lengthy and changes in the work environment may require subsequent adjustments to the machine set up.

The traditional shoe manufacturing techniques described above are well suited for mass production, where long and tedious set-up procedures can be spread out over large production runs for large quantities of shoes with a limited number of sizes. They are not so well suited for the manufacture of custom shoes, where production can be done on a pair-by-pair basis, or at least for much smaller quantities than found in normal mass production. Typically, custom shoes are handmade, relying on skilled artisans and taking several weeks or more to manufacture.

Accordingly, improved shoe manufacturing techniques and equipment are desirable as is an improved method of manufacturing custom shoes.

BRIEF SUMMARY OF THE INVENTION

Embodiments of the present invention provide improved shoe manufacturing techniques including a new method of operating a computerized, vision-aided sewing apparatus. The invention can be used to stitch one work piece to another or for stitching a decorative stitch line along a work piece.

In one embodiment, the method includes arranging a stencil over at least a portion of a work piece to be stitched. The stencil is cut from a material having a color selected to contrast with a color of the work piece. Next, a computer-controlled sewing apparatus having a machine-vision capability is used to stitch along a path that corresponds generally to an outer edge of the stencil. The computer-controlled sewing apparatus can adjust its stitching path in response to detecting the stencil. Then, after stitching is completed, the stencil is removed from the work piece.

In another embodiment, where a first work piece is stitched to a second work piece, the method includes arranging the first work piece so at least a portion of the piece overlies at least a portion of the second work piece and arranging a stencil over either the first or second work piece. The stencil is made from a material having a color that contrasts with a color of the first work piece. Next, the first work piece is stitched to the second work piece using a computer-controlled sewing apparatus having a machine-vision system. The machine-vision system facilitates stitching along or with reference to a stitching path that corresponds generally to an outer edge of the stencil and enables the sewing apparatus to adjust the sewing path in response to detecting the stencil. After stitching is completed, the stencil is removed.

In some embodiments, the machine-vision system for the stitching machine includes ultraviolet lamps to better illuminate the boundaries between the stencil and the work pieces.

Some embodiments of the invention are particularly useful for the manufacture of custom shoes, where many sizes of a given style of shoe (hundreds or even thousands of sizes), in production-run quantities as few as one half pair per size, can be stitched on a vision-aided computer stitching machine, with a minimum of set-up work required. Patterns output from a CAD/CAM system can include corresponding data to (i) cut and plot alignment lines on pallets used in the assembly of the shoes, (ii) cut the work pieces (shoe parts) to be stitched, (iii) cut the stencils used to guide the computer-controlled, machine-vision sewing system, and (iv) provide stitch line data for the stitching system.

These embodiments and others are described more fully in the Detailed Description below in conjunction with the following figures.

DETAILED DESCRIPTION OF THE INVENTION

As stated above, embodiments of the invention pertain to new techniques of using a computer-controlled, machine-vision sewing system to stitch a work piece. These embodiments employ a stencil that is made from a material having a color that contrasts with the primary color of the work piece. The stencil is then positioned with respect to the work piece in a manner such that an edge of the stencil parallels or defines a desired stitching path. Because of the contrasting colors, the machine-vision sewing system can detect the boundary between the stencil and the work piece and use this information to stitch the desired stitching path.

In some embodiments, the computer-controlled sewing system is pre-programmed with one or more predetermined stitching paths and uses its machine-vision system to adjust the predetermined stitching path with respect to the stencil as appropriate. In other embodiments, the computer controlled sewing system follows stitching commands (e.g., distances and general directions) rather than a predetermined stitching path. The system stitches thread along a path with respect to the stencil where the path is determined by referencing both the stitching commands and data representing the boundary between the stencil and work piece generated from the system's machine-vision system.

Embodiments of the invention can be used to stitch one work piece to another or to add decorative stitching to a work piece. Also, some embodiments of the invention use ultraviolet lamps to increase the contrast between the stencil and the work piece during the stitching operation. In order to better understand and appreciate the invention, an example of its use in the manufacture of custom shoes is described below. The description below is for exemplary purposes only. The invention can be used for other applications besides the manufacture of shoes.

Figure 1:
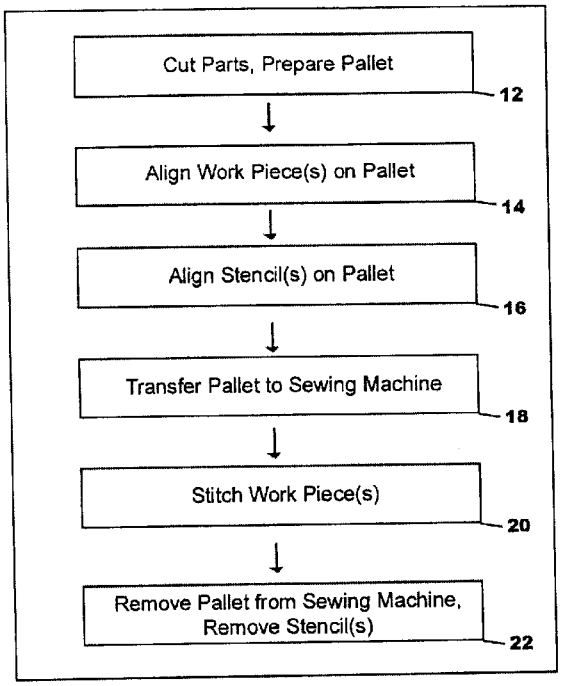
FIG. 1 is a flowchart illustrating one embodiment of the method of the present invention.

FIG. 1 is a flowchart showing one embodiment of a computer controlled stitching method (steps 12–22) according to the present invention as implemented in a method of manufacturing custom shoes. As shown in FIG. 1, prior to the stitching operation, various parts, including work pieces and stencils are cut from appropriate material (step 12). The work pieces are cut from material that is selected based upon the desired end product. For example, if the end product is a black leather wingtip shoe, the work pieces are cut from a piece of black leather. The stencils are cut from material that has a color selected to contrast with the primary color of the work piece material. For example, if the work piece material is dark (brown, black, blue, etc.), the stencils may be cut from a piece of white material. Similarly, if the work piece material is light (white, yellow, pink, etc.), the stencils may be cut from a piece of black material. In some embodiments the material used to create the stencils is posterboard or cardboard. The above discussion refers to a plural number of work pieces and stencils. In some embodiments, however, only one work piece and/or only one stencil is used.

Figure 2:
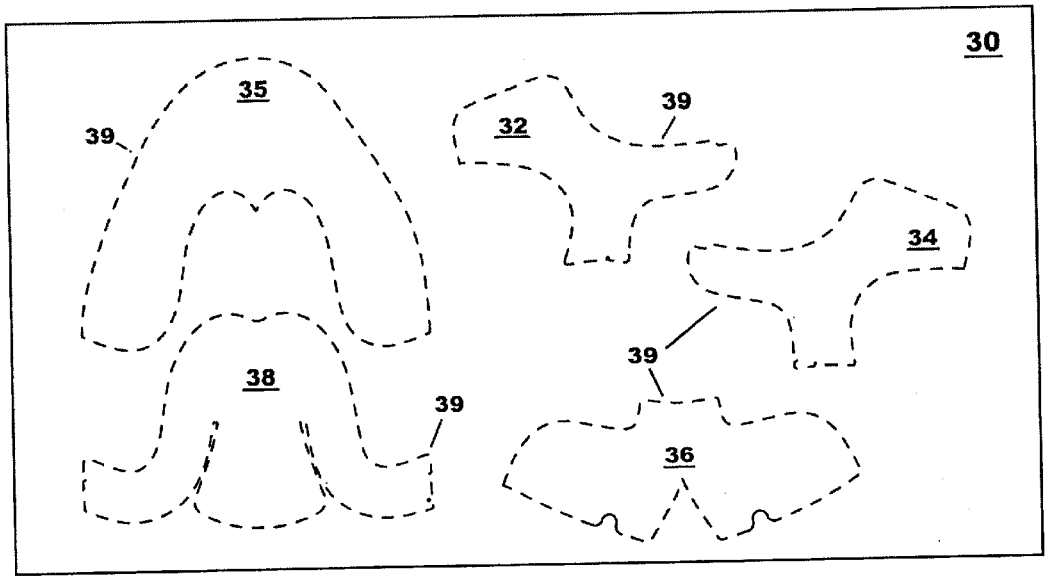
FIG. 2 is a simplified top plan view of a piece of material from which work pieces that are to be subsequently sewn together may be cut.

FIG. 2 is a top view of a piece of black leather 30 from which several work pieces for the manufacture of a men's wingtip shoe are to be cut. Shown in FIG. 2 are areas 32, 34, 35, 36 and 38 denoted by dashed lines 39 which will become work pieces after leather piece 30 is cut. For convenience, the reference numbers used in the discussion below to refer to individual work pieces is the same as the reference number used to denote the corresponding area from which the work piece is cut. Once cut, work piece 35 will be the shoe tip, piece 38 the vamp, piece 36 the foxing and pieces 32 and 34 the quarters.

Figure 3:
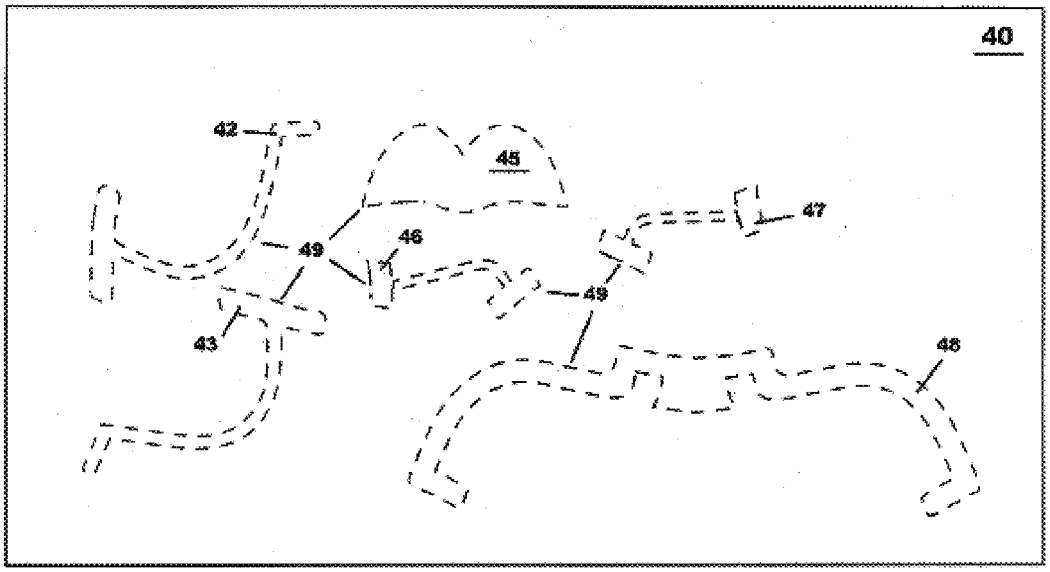
FIG. 3 is a simplified top plan view of a piece of material from which pieces that are to be used as stencils to guide a computer-controlled, machine-vision sewing system may be cut.

FIG. 3 is a top view of a piece of bleached white posterboard 40 from which several stencils are to be cut. Shown in FIG. 3 are areas 42, 43, 45, 46, 47 and 48 denoted by dashed lines 49 which will become stencils after posterboard 40 is cut. For convenience, the reference numbers used in the discussion below to refer to specific stencils are the same as the reference numbers used to denote the areas from which the stencils are cut.

Figure 4:
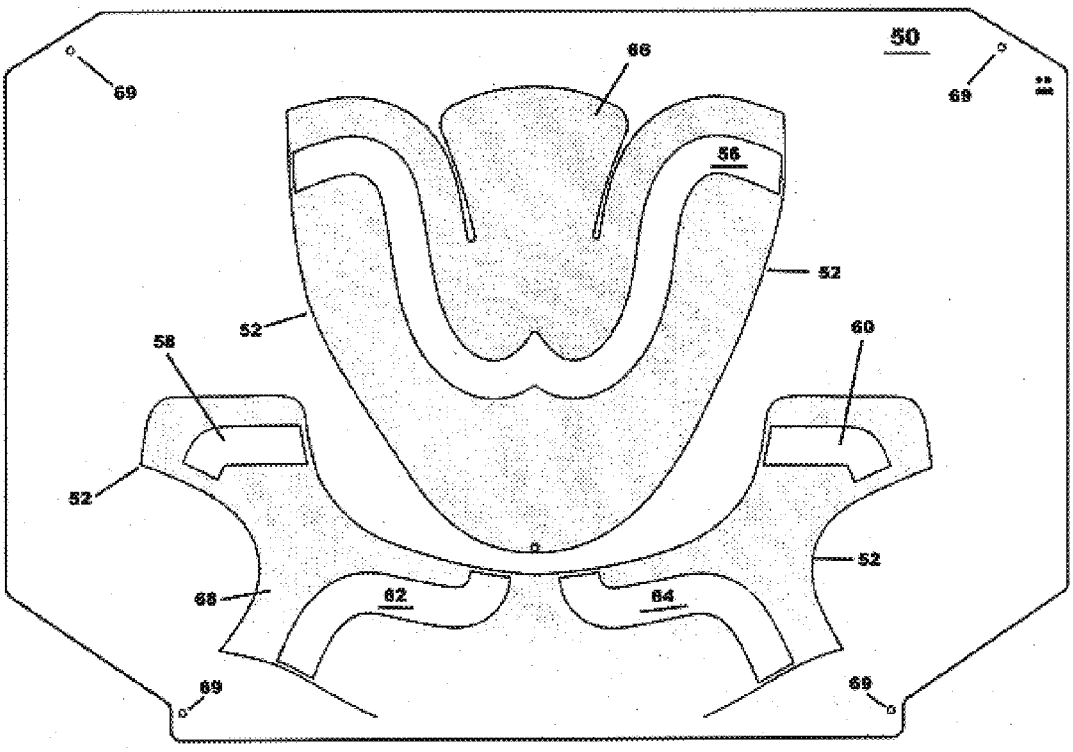
FIG. 4 is a top plan view of a pallet that may be used to facilitate the alignment of the work pieces cut from the pieces of material shown in FIGS. 2 and 3 prior to being stitched according to the method of the present invention.

Step 12 may also include creating a base or pallet upon which the work pieces and stencils are aligned prior to the stitching operation. FIG. 4 is a top view of a pallet 50 that was cut from a piece of cardboard. Pallet 50 includes plotted lines 52 that outline the positions the work pieces or stencils are to be placed on the pallet in preparation for stitching. Pallet 50 also includes windows 56, 58, 60, 62 and 64 in areas where the work pieces will be stitched. These windows can be cut from pallet 50 in the same manner that the work pieces and stencils are cut from pieces of material 30 and 40, respectively.

In one specific embodiment, the cutting of step 12 (and plotting as appropriate) is performed at a computer-controlled cutting table, such as a Model LC 1800 manufactured by Zund Corporation and cutting data that controls the cutting table is generated from a digitally created pattern stored in a computer-readable medium such as a hard disk drive. As previously mentioned, custom shoe manufacturing may use hundreds or even thousands of different sizes (and thus patterns) to produce shoes that have a more exacting fit for an individual wearer than mass produced shoes. (Mass produced shoes typically use at least an order of magnitude fewer sizes and more typically only between about 15–45 sizes for men's casual and dress shoes.) Thus, rather than have steel cutting dies made for each size of a style of shoe from a set of paper patterns produced for each size of last, some embodiments of the present invention use digitally stored, computer generated patterns to guide the operation of the cutter. In this manner, work pieces can be cut with a very high degree of accuracy.

In one embodiment the digital patterns are created from input files that represent a three dimensional digital representation of lasts ("digital lasts") created in a CAD/CAM system for each size of the custom shoes. For a typical custom shoe line there may be over 1000 different sizes thus requiring over 1000 digitized lasts. The digital patterns, one set for each digital last, are created from these three dimensional digital lasts using mathematical flattening algorithms as is known to those of skill in the art. When an individual's foot is digitized it can be compared to the three dimensional digital lasts using a best fit analysis to determine the set of digital patterns that should be referenced by the cutter during step 12. Once a match is determined, the patterns for the matching last can be downloaded to the cutter to create an appropriate pallet and cut the necessary work pieces and stencils. This process eliminates the need to make steel cutting dies that are otherwise required to cut the work pieces and results in more accurate cuts and more accurate plotted lines than is possible with cutting dies.

The LC 1800 cutting table is equipped with over head projectors that project the patterns onto a piece of material prior to the actual cutting operation. This allows an operator to move the projected parts with an input device such as a mouse to avoid including scratches, scars or other defects in the material within work pieces such as pieces 32, 34, 35, 36 and 38. The operator also may move the projected parts in order to get the best yield from a given piece of material. The cutting head of the Zund LC1800 plotting/cutting table includes four (4) separate tools: an oscillating knife that cuts the material; a pen that plots lines; and two routers that punch different size holes in the material for alignment and/or for decorative purposes. Having four tools on this table enables the table to plot lines and cut work pieces from the same set of digital patterns as part of a single continuous operation.

After the various pieces and stencils are cut, each work piece is split on a special designed band saw to a predetermined thickness and then skived prior to being aligned on the pallet for stitching. The skiving operation bevels the edges of the work pieces where they overlay another piece and can be done on commercially available computer-controlled machines such as a skiver manufactured by Fortuna, a German company. Typically the leather work pieces being stitched during the manufacture of shoes are split to a thickness of at least 1.0 mm, although the desired thickness is dependent upon the style of shoe and is not dictated by any stitching criteria or other requirements.

Next, work pieces 32, 34, 35, 36 and 38 are aligned on a pallet 50 using plotted lines 52 that outline the positions of the work pieces (FIG. 1, step 14). The individual work pieces are held in place on pallet 50 by a water-based cement which is applied to areas 66 and 68 (shaded areas) of the pallet.

A latex cement glue is then applied to the back of the stencils and allowed to dry for a couple of minutes to a tacky texture. Then the stencils are placed on the pallet using reference points, such as plotted lines 52 and the work pieces themselves to properly align the stencils with respect to the work pieces (FIG. 1, step 16). Prior to being applied to the stencils, the latex cement is diluted to an appropriate adhesive strength so it will secure the stencils to the work pieces and/or pallet during the stitching operation but enable the stencils to be readily removed from the work pieces and/or pallet after stitching is complete.

Figure 5:
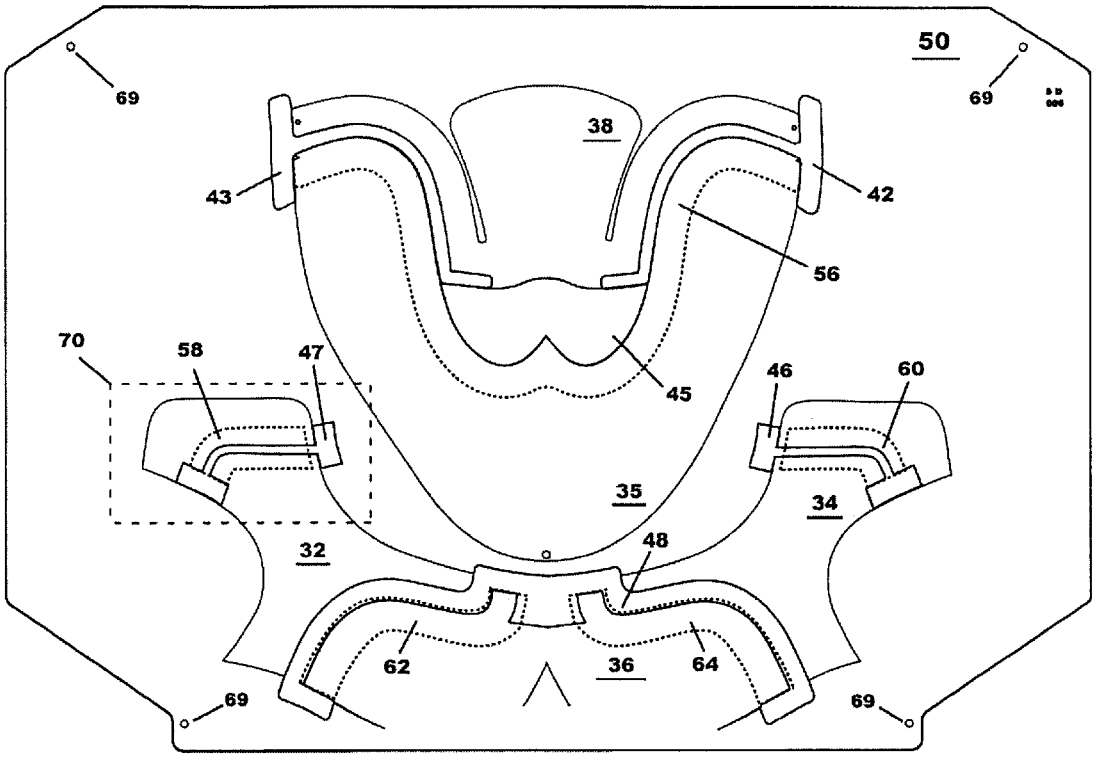
FIG. 5 is a top plan view of the pallet shown in FIG. 4 having the work pieces and stencils aligned thereon.

In situations where an upper work piece is stitched to an underlying work piece, a desired stitch path that attaches the upper work piece to the underlying piece may be offset, for example 1 mm, from an edge of the upper piece. In such a case, some embodiments of the invention create a stencil to be positioned over the lower work piece such that an edge of the stencil abuts the edge of the upper work piece. In other instances, for example, when providing decorative stitching, a stencil is arranged over the work piece to be stitched such that an edge of the stencil is parallel to the desired stitching line. FIG. 5 shows a pallet 50 having work pieces 32, 34, 35, 36 and 38 and stencils 42, 43, 45, 46, 47 and 48 aligned thereon.

Next, the pallet is loaded into the computer controlled vision-aided stitching apparatus, e.g., a See-N-Sew stitching machine manufactured by Orisol Ltd. (FIG. 1, step 18), and the work pieces are stitched (FIG. 1, step 20). The pallet may be positioned correctly within the stitching machine by means of four (4) punch holes 69 in the comers of the pallet. The computer-controlled vision-aided stitching apparatus begins stitching the parts according to a pre-programmed sequence of stitch line trajectories, using the position of the stencils to determine starting and stopping points, and to align and correct the alignment of those stitch line trajectories.

The contrast between the black leather work pieces and white stencils (especially when illuminated under a black light as discussed below) is especially clear and detectable by the machine's vision system. Thus, little programming is required to recognize the boundaries between the stencils and work pieces. For the most part, there is one "standard" light setting for all sizes and all materials, when "capturing" or trying to recognize the boundaries. However, under edge-recognition vision-guided stitching systems, extensive programming and manipulation of the various lighting parameters may be required to "capture" a distinct line for each size of a shoe style and for each material or material color (even for the same size shoe pattern).

In one embodiment stitching is done by following predetermined stitching paths that are generally aligned with and offset from various edges of the stencils. The predetermined stitching paths represent the expected location of the desired stitching lines and can be output from the CAD/CAM pattern file. Each stitching path is typically associated with one or more edges from one or more stencils. The stitching apparatus uses its machine vision to correct stitching paths as necessary to better follow the perimeter of the associated stencil edge. The machine vision can be used by scanning the work piece prior to stitching to create a data file representative of the stitching line and then modifying the data file representing the predetermined stitching path based on a comparison of this data file to the stitching path data file. Alternatively, the machine vision can be used to detect the stencil during the stitching operation and modify the stitching path in real time if it is determined that the path does not exactly follow the boundary between the stencil and the work piece. In still another embodiment, the predetermined stitching path can be represented by general instructions such as start stitching from a location 2 mm inside a first comer of a stencil, stitch along the stencil's edge (1 mm offset) to within 3 mm of a second comer of the stencil and then stop and stitch a second thread using the same stitching path but offset 3 nm from the stencil's edge. Having been so described, such programming is within the capabilities of a person of skill in the art.

Figure 6:
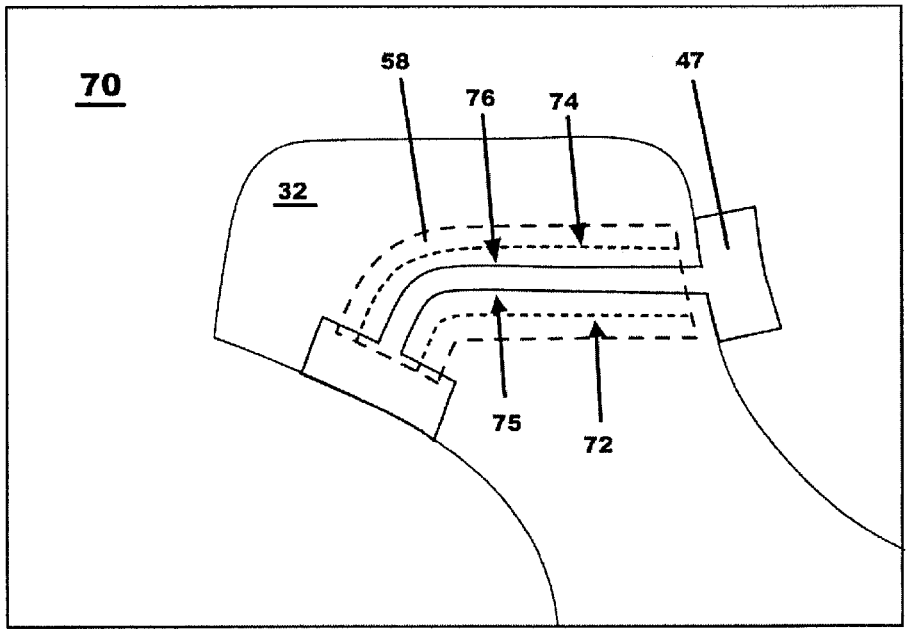
FIG. 6 is an enlarged view of area 70 shown in FIG. 5.

FIG. 6 is an enlarged view of area 70 shown in FIG. 5. Shown in FIG. 6, is work piece 32 positioned over the portion of pallet 50 that includes window 58 (indicated by the long dashed lines). Stencil 47 is positioned over work piece 32. Also shown in FIG. 6 are two parallel desired stitching paths 72 and 74 for decorative thread that are offset, e.g., 3 mm, from edges 75 and 76, respectively, of stencil 47. In this example, the sewing system is preprogrammed with stitching commands to stitch all the necessary paths to attach the work pieces to each other and stitch decorative threading. Thus, after being loaded in the machine-vision sewing system, the system begins to stitch according to its program. When the portion of the program that stitches path 72 is reached, the sewing system detects the boundary between edge 75 of stencil 47 and underlying work piece 32. To the extent that the data representing the pre-programmed stitching paths varies from path 72 shown in FIG. 6, the sewing system adjusts its stitching path to follow path 72 as defined by edge 75 of the stencil. When stitch path 72 is completed, the sewing system starts stitching the next pre-programmed stitch path, by referencing the appropriate stencil edge. For example, the machine may stitch stitching path 74 by referencing edge 76 of stencil 47. The same can be done for other desired stitching paths as defined by edges of other stencils.

After, stitching is completed, the pallet is removed from the sewing system and the stencils are taken off the stitched work pieces (FIG. 1, step 22). The work pieces are then ready for the next step in the shoe manufacturing process.

As previously mentioned, vision-aided sewing machines previously known to the inventors use edge detection routines to follow the stitching path and adjust/correct for deviations that may be required in the path. In contrast, the present invention uses the machine-vision capability of the sewing machine to follow a stencil. Having the machine-vision sewing machine focus on the stencil as opposed to an edge of a work piece being stitched greatly simplifies the vision-assisted stitching operation and increases the accuracy of the operation. Previous computer-controlled machine-vision sewing machines required numerous lights placed at a variety of angles to maximize the ability of the machine to detect the work piece edge. Edge detection is a complicated process, however, and slight variations in the lighting conditions, work piece characteristics (e.g., color of the leather) or other factors may cause the edge detection software to not function properly, and may require further programming and manipulation.

In contrast, programming the computer-controlled, vision-aided sewing machine to follow the boundary between a work piece and contrasting stencil is relatively simple. As previously described, the stencils should be made from a material having a high contrast with respect to the work piece material. For example, a black stencil provides excellent contrast on a light colored work piece. Similarly, a white stencil provides good contrast on a dark colored work piece.

In order to better detect the boundaries between the stencils and the work pieces in some embodiments, the computer controlled machine vision sewing machine includes ultraviolet lamps instead of standard light bulbs that may be used in other embodiments. Certain embodiments also include a mechanism to block ambient light from the stitching area (e.g., draping a dark curtain around the stitching area). The inventors have found that one (1) ultraviolet light source, using a high pressure 100 watt mercury vapor short arc lamp with bandpass filters to permit the transmission of ultraviolet light while blocking most of the visible light, and outfitted with two (2) flexible liquid filled light guides to deliver the light from the lamp to the stitching area, placed in a See-N-Sew stitching machine manufactured by Orisol Ltd. can be used in place of twenty (20) or more regular light bulbs recommended by the manufacturer for use in edge detection.

In order to better appreciate the difference in programming of the vision-aided stitching machine afforded by the present invention, consider one embodiment of the present invention where the vision-aided stitching machine is a Sew-N-See stitcher manufactured by Orisol. A See-N-Sew stitching machine operated without the benefit of the present invention includes more than twenty (20) light bulbs positioned in two (2) layers of circles above the stitching area. These two (2) layers are in fact arranged in three (3) different configurations, which the operator has to choose from when "programming" the machine's lighting. These three (3) configurations include an all bottom ring; an all top ring and a combination of lights from the top and bottom rings. Aside from selecting one of these three (3) configurations, the operator also decides whether to turn on or turn off individual lights in the configuration chosen.

It is up to the machine operator to "program" these lights for each frame taken by the vision system. There may be something in the neighborhood of fifty (50) or more frames taken for a given stitching program. That is, to stitch the parts aligned in a typical pallet, there are more than fifty (50) frames captured by the vision system. The operator must "program" the lighting conditions for each of these fifty-plus (50+) frames, one-by-one. By "programming", the operator must determine which configuration of lighting to use and then which lights are turned ON and which are left OFF, with the intent to create the best lighting direction to accent the edge of the material for detection of that edge for each and every frame. In addition to this, the operator must adjust the intensity of the light for each frame. For the Orisol machine, the intensity of the light is really the opening of the camera aperture.

It is not unusual for an operator to spend a minute or more on each frame. Also, it is normal to have to come back, after doing "dry-run" testing of a programmed lighting, and have to make adjustments to lighting again, frame by frame addressing any problems that may show up in the edge detection process.

In addition to all the adjustments noted above, the operator must decide on one of three (3) different edge detection algorithms to use as part of the lighting adjustment for each frame. These algorithms include: shadow; white; or contrast. The SHADOW algorithm detects the edge when going from light to dark; the WHITE algorithm detects the edge between dark and light; and the CONTRAST is like WHITE but with some subtleties on how and where the light comes from. Once the operator decides on the algorithm, the programming is input into the stitching machine and the machine is ready for use.

When operated according to the method of the present invention, the twenty-plus (20+) bulbs of the See-N-Sew machine are removed. In their place is positioned one (1) light source that feeds light to the workplace via two (2) light guides. During line detection the light is kept always ON, it is not necessary to change the intensity and the algorithm can be set to SHADOW. Changes to this program are not necessary on frame-by-frame bases.

Having described the present invention with respect to the manufacture of one particular style of custom shoes, a person of skill in the art will recognize that the invention has much broader applicability. For example, the invention may be used to produce any style and type of shoe including shoes with far fewer sizes than custom shoes. Additionally, the present invention may be used to stitch work pieces other than those used for the assembly of shoes. For example, the invention may be used to stitch purses, jackets, gloves and other leather goods and may be also used to stitch similar goods made of synthetic materials and materials other than leather. The present invention may also be used to add decorative stitching to a work piece as opposed to stitching two separate work pieces together.

Furthermore, the invention has been illustrated with specific embodiments by way of example only. A person of skill in the art will recognize that many alternative and equivalent methods of practicing the present invention exist. For example, step 20 is illustrated as stitching various work pieces together using a See-N-Sew computer stitching machine manufactured by Orisol Ltd. Other computer controlled, vision-aided stitching machines can be used to sew the work pieces or other appropriate machines can be specifically manufactured for this step. A vision-aided stitching machine (a stitching machine having a machine-vision system) within the context of the present invention refers to any machine that can detect the boundary between a stencil and work piece being stitched because of their contrasting colors. Similarly, other methods of cutting the work pieces (e.g., with a waterjet) and aligning the work pieces can be used. Also, the present invention can be used in the manufacture of shoes from digital patterns that are generated from physical rather than digital lasts. As another example, the stencils can be attached to pallet 50 or the work pieces using techniques other than glue or latex cement. For example, they may be taped, stapled or otherwise tacked to the pallet or work pieces. In still another example, pallets, such as pallet 50, are not necessary. Instead, the stencils may be positioned over a work piece and the work piece transferred directly to the stitching machine where it is clamped between belts that enable the piece to be moved in x and y directions during the stitching process. Also, the order of steps 14 and 16 can be intermixed. For example, in some embodiments some work pieces may be positioned first, followed by some stencils and then additional work pieces. The present invention is only intended to be limited by the claims listed below.

What is claimed is:

1. A method of stitching a work piece, said method comprising:

arranging a stencil over at least a portion of said work piece, wherein said stencil is cut from a material having a color selected to contrast with a color of said work piece;

using a computer-controlled sewing apparatus having a machine-vision capability to stitch along a path that corresponds generally to an outer edge of said stencil, wherein said computer-controlled sewing apparatus can adjust its stitching path in response to detecting said stencil; and removing said stencil from said work piece.

2. The method of claim 1 wherein said work piece is a shade of brown or black and said stencil is a shade of white.

3. The method of claim 1 wherein said step of arranging said stencil over said work piece includes attaching said stencil to said work piece with glue.

4. The method of claim 3 wherein said glue is sprayed on a backside of said stencil and allowed to dry before attaching said stencil to said work piece.

5. The method of claim 1 wherein said method further comprises arranging said work piece on a pallet and attaching said stencil to said pallet.

6. The method of claim 1 wherein said machine vision system includes ultraviolet lights.

7. The method of claim 1 wherein said path is offset a predetermined distance from said outer edge of said stencil.

8. A method for attaching a first work piece to a second work piece, the method comprising:

arranging said first work piece so at least a portion of the piece overlies at least a portion of said second work piece;

arranging a stencil over either said first or second work piece, wherein said stencil is made from a material having a color that contrasts a color of said first work piece;

thereafter, stitching said first work piece to said second work piece using a computer-controlled sewing apparatus having a machine-vision system to facilitate stitching along or with reference to a stitching path that corresponds generally to an outer edge of said stencil; and thereafter, removing said stencil.

9. The method of claim 8 wherein said machine vision system includes ultraviolet lights.

10. The method of claim 8 wherein said first and second work pieces are parts of a shoe.

11. The method of claim 8 wherein said stitching path is offset a predetermined distance from said outer edge of said stencil.

12. The method of claim 8 wherein said step of arranging said stencil comprises arranging said stencil over said second work piece so that at least a portion of an outer edge of said stencil abuts at least a portion of an outer edge of said first work piece.

13. The method of claim 8 wherein said first work piece has a thickness of at least 1.0 mm.

14. The method of claim 8 wherein:

said computer controlled sewing apparatus is programmed to stitch along a predetermined path stored in a first data file, said predetermined path corresponding generally with an outer edge of said stencil;

said machine vision system scans said first work piece to create a second data file including data representing at least a portion of the outer edge of said stencil; and said computer controlled sewing machine references both said first and second data files to stitch said first work piece to said second work piece.

15. The method of claim 8 wherein:

said computer controlled sewing apparatus is programmed to stitch along a predetermined stitching path stored in a first data file, said predetermined path corresponding generally with an outer edge of said stencil;

said machine vision system is used to detect said outer edge of said stencil while said sewing machine is stitching along said predetermined path; and said predetermined stitching path can be altered in response to detecting said outer edge of said stencil.

16. The method of claim 8 wherein said step of arranging said stencil over either said first or second work pieces includes attaching said stencil to either one of said work pieces with glue.

17. A process for manufacturing shoes, the process comprising:

using a computer-controlled apparatus to cut a work piece from a first piece of material of a first color according to a predetermined pattern stored in computer-readable medium;

using a computer-controlled apparatus to cut a stencil from a second piece of material of a second color according to a predetermined pattern stored in computer-readable medium, wherein said second color is selected to contrast with said first color;

arranging said stencil over at least a portion of said work piece; and using a computer-controlled sewing apparatus to stitch said work piece along a programmed sewing path that corresponds generally to an outer edge of said stencil, wherein said computerized sewing apparatus includes a machine vision capability enabling it to adjust its sewing path in response to detecting said stencil; and removing said stencil from said work piece.

18. The process of claim 17 further comprising digitizing a pair of feet with a scanning device to create a digitized data file and comparing said digitized data file to a plurality of digitized lasts using a best fit algorithm to select a best matching digital last, and wherein said predetermined pattern is generated from said best matching digital last.

19. The process of claim 17 wherein said stencil is cut from bleached white paper.

20. The process of claim 17 wherein said first work piece has a thickness of at least 1.0 mm.

21. The process of claim 17 wherein said programmed sewing path is offset from an outer edge of said stencil.

* * * * *